US006595842B2

(12) United States Patent
Misiura

(10) Patent No.: US 6,595,842 B2
(45) Date of Patent: Jul. 22, 2003

(54) ABRASIVE PAD AND METHOD OF MAKING SAME

(76) Inventor: Joseph A. Misiura, 346 Timber Ridge Dr., Suite 100, Bartlett, IL (US) 60103

( * ) Notice: Subject to any disclaimer, the term of this patent is extended or adjusted under 35 U.S.C. 154(b) by 0 days.

(21) Appl. No.: 09/876,856

(22) Filed: Jun. 7, 2001

(65) Prior Publication Data

US 2002/0119741 A1 Aug. 29, 2002

Related U.S. Application Data

(60) Provisional application No. 60/210,104, filed on Jun. 7, 2000.

(51) Int. Cl.[7] ..... B24D 13/06

(52) U.S. Cl. ..... 451/528; 451/531; 451/533; 451/537; 15/230.14

(58) Field of Search ..... 451/526, 531, 451/533, 537, 466, 532, 538, 539; 15/230.14, 230.15, 230.16, 181, 223

(56) References Cited

U.S. PATENT DOCUMENTS

| | | | | | |
|---|---|---|---|---|---|
| 709,312 | A | * | 9/1902 | Farnham | 15/230.14 |
| 1,697,442 | A | * | 1/1929 | Webber | 451/537 |
| 2,771,722 | A | | 11/1956 | Field | |
| 2,789,305 | A | | 4/1957 | Weil | |
| 2,815,617 | A | * | 12/1957 | Bernstein | 451/510 |
| 3,417,420 | A | | 12/1968 | Rock | |
| 3,597,887 | A | | 8/1971 | Hall, Jr. | |
| 4,199,835 | A | | 4/1980 | Heyer et al. | |
| 4,835,912 | A | | 6/1989 | Block | |
| 5,125,192 | A | | 6/1992 | Welsch | |
| 5,142,829 | A | * | 9/1992 | Germain | 451/537 |
| 5,197,998 | A | | 3/1993 | Germain | |
| 5,405,286 | A | * | 4/1995 | Welsch | 451/527 |
| 5,643,068 | A | | 7/1997 | Ward, Sr. | |
| 5,851,142 | A | * | 12/1998 | Bullock | 451/508 |
| 6,379,238 | B1 | * | 4/2002 | Beechey et al. | 451/532 |

* cited by examiner

*Primary Examiner*—George Nguyen
(74) *Attorney, Agent, or Firm*—Porter, Wright, Morris & Arthur LLP

(57) ABSTRACT

An abrasive pad removably attachable to a driven rotatable shaft and including a plurality of angularly offset abrasive members. Each abrasive member includes an outwardly facing surface having an abrasive disposed thereon. A first abrasive member is partially received within a loop formed by a second abrasive member. Likewise the second abrasive member is partially received within a loop formed by a third abrasive member. Finally, the third abrasive member is partially received within a loop formed by a fourth abrasive member. Each abrasive member is angularly offset from a radially adjacent abrasive member by approximately 45° with each abrasive member lying substantially in a single plane. Also disclosed is a method for forming such an abrasive pad.

27 Claims, 12 Drawing Sheets

ABRASIVE PAD AND METHOD OF MAKING SAME

RELATED APPLICATION

This application claims the benefit of U.S. provisional patent application No. 60/210,104, filed Jun. 7, 2000.

BACKGROUND OF THE INVENTION

1. Field of the Invention

The present invention relates to abrasive articles and, more particularly, to an abrasive pad comprising a plurality of overlapping abrasive strips. Also disclosed is a related method of making such an abrasive pad.

2. Description of the Prior Art

Abrasive pads are generally well known in the art and are typically driven in rotation by the output shaft of a rotary or orbital tool to abrade material from a workpiece. One common type of abrasive pad, often called a square or cross pad, includes a pair of abrasive members disposed in a perpendicular relationship to each other. Each abrasive member in such a square or cross pad comprises at least one strip of coated abrasive cloth formed into a loop. A connector is disposed centrally within the abrasive pad and is attachable to a driven rotating shaft. Such abrasive pads are readily available on the market, for example, from Arc Abrasives Inc. of Troy, Ohio.

The above described abrasive pads are often used to abrade surfaces within tight corners or proximate joints of workpieces, and are widely used to abrade welds positioned in the corners of steel tanks. Such traditional square or cross pads suffer from the disadvantage of having sharp corners that often impact the surface being abraded when rotated. Such contact with the corners of the abrasive pad often makes the rotary or orbital supporting tool difficult to operate and reduces the efficiency of the abrading operation. Additionally, such impact typically accelerates wear and reduces the life expectancy of the abrasive pad. Contact between the corners and the workpiece also may cause discomfort or even repetitive stress injuries to a user.

A further disadvantage with traditional cross pads is that they provide a relatively limited abrasive edge surface for abrading a workpiece. As may be appreciated, the operator must therefore devote more time to remove material from the workpiece.

Accordingly, there remains a need for an abrasive pad having an extended abrasive edge surface and that also eliminates sharp corners from impacting the surface of the workpiece to be abraded.

Therefore, it is an object of the present invention to provide an abrasive pad of simple and inexpensive design.

It is another object of the invention to provide an abrasive pad that may be easily and removably mounted on a powered rotary member to rotate against a workpiece and provide an abrading action against the workpiece.

It is yet another object of the present invention to provide an abrasive pad having a long life.

It is a farther object of the invention to provide an abrasive pad that is disposable when the individual abrasive strips become worn.

It is still another object of the invention to provide an abrasive pad having no sharp corners and that may be readily used in tight corners and other confined areas.

It is another object of the present invention to provide an abrasive pad that prevents or reduces operator discomfort and injury.

It is yet another object of the present invention to provide an abrasive pad having an extended abrasive edge surface and that also eliminates sharp corners from impacting the surface of the workpiece to be abraded.

It is a further object of the present invention to provide a method of manufacturing such an abrasive pad that is simple and efficient.

These and other objects of the present invention will be apparent from the description that follows, the appended claims, and the drawings.

SUMMARY OF THE INVENTION

The present invention provides an abrasive pad that is removably attachable to a driven rotatable shaft for abrading a workpiece and a method of making such an abrasive pad. A preferred embodiment of the abrasive pad includes first, second, third, and fourth abrasive members each including an outwardly facing surface with a plurality of abrasive particles supported thereon. The first abrasive member is secured substantially perpendicular to the second abrasive member. The third abrasive member is positioned angularly intermediate the first and second abrasive members and secured to the second abrasive member. The fourth abrasive member is positioned substantially perpendicular to the third abrasive member and angularly intermediate the first and second abrasive members and is secured to the third abrasive member. Each of the abrasive members may be offset angularly from radially adjacent abrasive members by approximately 45°. Each of the abrasive members also may comprise a plurality of abrasive strips aligned in an overlapping relationship.

In another preferred embodiment, the abrasive pad includes a first abrasive member including an outwardly facing surface with a plurality of abrasive particles supported thereon and a second abrasive member defining a loop including an outwardly facing surface with a plurality of abrasive particles supported thereon. The first abrasive member is positioned substantially perpendicular to the second abrasive member and a central portion of the first abrasive member is received within the loop of the second abrasive member. A third abrasive member defining a loop including an outwardly facing surface with a plurality of abrasive particles supported thereon is positioned angularly intermediate the first and second abrasive members and a central portion of the second abrasive member is received within the loop of the third abrasive member. A fourth abrasive member defining a loop including an outwardly facing surface with a plurality of abrasive particles supported thereon is positioned substantially perpendicular to the third abrasive member and angularly intermediate the first and second abrasive members and a central portion of the third abrasive member is received within the loop of the fourth abrasive member. Each of the abrasive members may be offset angularly from radially adjacent abrasive members by approximately 45°. Each of the abrasive members also may comprise a plurality of abrasive strips aligned in an overlapping relationship.

In yet another preferred embodiment, the abrasive pad includes a first abrasive member including opposing ends and a pair of side edges extending between the opposing ends, the first abrasive member further including an outwardly facing surface and a plurality of abrasive particles supported on the outwardly facing surface. A second abrasive member includes a loop having upper and lower portions and opposing ends connecting the upper and lower portions, with each of the upper and lower portions having a pair of side edges extending between the opposing ends. The second abrasive member further includes an outwardly facing surface and a plurality of abrasive particles supported on the outwardly facing surface. The second abrasive member is positioned substantially perpendicular to and in partial overlapping relationship with the first abrasive member. A third abrasive member includes a loop having upper and lower portions and opposing ends connecting the upper and lower portions, with each of the upper and lower portions having a pair of side edges extending between the opposing ends. The third abrasive member further includes an outwardly facing surface and a plurality of abrasive particles supported on the outwardly facing surface. The third abrasive member is positioned angularly intermediate the first and second abrasive members and in partial overlapping relationship with at least one of the first and second abrasive members. A fourth abrasive member includes a loop having upper and lower portions and opposing ends connecting the upper and lower portions, with each of the upper and lower portions having a pair of side edges extending between the opposing ends. The fourth abrasive member further includes an outwardly facing surface and a plurality of abrasive particles supported on the outwardly facing surface. The fourth abrasive member is positioned substantially perpendicular to the third abrasive member and angularly intermediate the first and second abrasive members. The fourth abrasive member also is positioned in partial overlapping relationship with at least one of the first and second abrasive members.

The first abrasive member may include a loop having upper and lower portions extending between the opposing ends. The distance between the opposing ends of the first abrasive member may be less than a distance between the opposing ends of the third abrasive member, the distance between the opposing ends of the first abrasive member may be substantially equal to a distance between the opposing ends of the second abrasive member and the distance between the opposing ends of the third abrasive member may be substantially equal to a distance between the opposing ends of the fourth abrasive member. The opposing ends of the third and fourth abrasive members may partially overlap the opposing ends of the first and second abrasive members.

The first abrasive member may be partially received between the upper and lower portions of the second, third and fourth abrasive members, the second abrasive member may be partially received between the upper and lower portions of the third and fourth abrasive members, and the third abrasive member may be partially received between the upper and lower portions of the fourth abrasive member. Each of the abrasive members may be offset angularly from radially adjacent abrasive members by approximately 45°. Each of the abrasive members may comprise a plurality of abrasive strips aligned in an overlapping relationship.

The above-described abrasive pad may further include a connector supported by the abrasive members and substantially centered intermediate the opposing ends of each of the abrasive members. The connector may comprise an internally threaded rivet extending through each of the abrasive members.

In still another preferred embodiment, the abrasive pad includes a first abrasive strip including a pair of outwardly facing surfaces and a plurality of abrasive particles supported on the pair of outwardly facing surfaces. A second abrasive strip formed into a loop includes a pair of outwardly facing surfaces, a plurality of abrasive particles supported on the pair of outwardly facing surfaces, and a pair of opposing inwardly facing surfaces. The first abrasive strip is positioned at an angle to the second abrasive strip and partially received intermediate the opposing inwardly facing surfaces of the loop of the second abrasive strip. A third abrasive strip formed into a loop includes a pair of outwardly facing surfaces, a plurality of abrasive particles supported on the pair of outwardly facing surfaces, and a pair of opposing inwardly facing surfaces. The loops of the first and second abrasive strips are positioned at an angle to the third abrasive strip and the loop of the first abrasive strip is partially received intermediate the opposing inwardly facing surfaces of the loop of the third abrasive strip. A fourth abrasive strip formed into a loop includes a pair of outwardly facing surfaces, a plurality of abrasive particles supported on the pair of outwardly facing surfaces, and a pair of opposing inwardly facing surfaces. The loop of the third abrasive strip is positioned at an angle to the fourth abrasive strip and is partially received intermediate the opposing inwardly facing surfaces of the loop of the fourth abrasive strip.

The first abrasive strip may be formed into a loop defining the pair of outwardly facing surfaces and a pair of opposing inwardly facing surfaces. Each of the loops formed by the abrasive members may include upper and lower portions and opposing edges connecting the upper and lower portions, the edges of all of the loops being disposed substantially in a single plane. Opposing ends of the loops of the third and fourth abrasive strips may partially overlap the opposing ends of at least one of the loops of the first and second abrasive strips.

Each of the abrasive strips may comprise a plurality of abrasive strips aligned in an overlapping relationship. Each of the loops formed from the abrasive members may be offset angularly from radially adjacent loops by approximately 45°.

The above-described abrasive pad may further include a connector supported by the abrasive strips. The connector may include an internally threaded rivet.

A preferred method of making an abrasive pad, includes the steps of providing first, second, third and fourth abrasive members each including an outwardly facing surface with a plurality of abrasive particles supported thereon, positioning the first abrasive member substantially perpendicular to the second abrasive member; securing the first abrasive member to the second abrasive member; positioning the third abrasive member angularly intermediate the first and second abrasive members; securing the third abrasive member to the second abrasive member, positioning the fourth abrasive member substantially perpendicular to the third abrasive member and angularly intermediate the first and second abrasive members; and securing the fourth abrasive member to the third abrasive member. The method may further include the steps of folding each of the second, third, and fourth abrasive members to define a loop, a central portion of the first abrasive member to be received within the loop of the second abrasive member, causing a portion of the second abrasive member to be received within the loop of the third abrasive member, and causing a central portion of the third abrasive members to be received within the loop of the fourth abrasive member.

In another preferred embodiment, the method of making the abrasive pad includes the steps of providing first, second, third and fourth strips of abrasive material, each of the strips having first and second surfaces and an abrasive disposed on the second surface; folding the first strip into a first loop wherein the second surface defines a pair of outwardly facing abrasive surfaces, the first surface defines a pair of opposed inwardly facing surfaces, and a pair of end edges connect the pairs of outwardly and inwardly facing surfaces; positioning the second strip in angularly offset relation to the first loop and intermediate the pair of end edges of the first loop, wherein a portion of the first surface of the second strip engages a portion of one of the outwardly facing surfaces of the first loop; folding the second strip into a second loop wherein the second surface defines a pair of outwardly facing abrasive surfaces, the first surface defines a pair of opposed inwardly facing surfaces, a pair of end edges connect the pairs of outwardly and inwardly facing surfaces, and the first loop is partially received intermediate the opposed inwardly facing surfaces of the second loop; positioning the third strip in angularly offset relation to the first and second loops wherein a portion of the first surface of the third strip engages a portion of one of the outwardly facing surfaces of at least one of the first and second loops; folding the third strip into a third loop wherein the second surface of the third strip defines a pair of outwardly facing abrasive surfaces, the first surface defines a pair of opposed inwardly facing surfaces, a pair of end edges connect the pairs of outwardly and inwardly facing surfaces, and the first and second loops are partially received intermediate the opposed inwardly facing surfaces of the third loop; positioning the fourth strip in angularly offset relation to the first and second loops wherein a portion of the first surface of the fourth strip engages a portion of one of the outwardly facing surfaces of the third loop; and folding the fourth strip into a fourth loop wherein the second surface of the fourth strip defines a pair of outwardly facing abrasive surfaces, the first surface defines a pair of opposed inwardly facing surfaces, a pair of end edges connect the pairs of outwardly and inwardly facing surfaces, and the third loop is partially received intermediate the opposed inwardly facing surfaces of the fourth loop.

The method may further include the steps of forming an aperture through the loops intermediate the end edges of loops; inserting a connector through the aperture; and securing the connector to loops. The method also may include the steps of securing the second loop to the first loop after the step of folding the second strip, securing the third loop to the second loop after the step of folding the third strip, and securing the fourth loop to the third loop after the step of folding the fourth loop. The steps of folding the third and fourth strips may include partially covering the end edges of the first and second loops with the end edges of the third and fourth loops.

Additional features and advantages of various preferred embodiments of the invention will be better understood in view of the detailed description provided below.

DETAILED DESCRIPTION OF THE PREFERRED EMBODIMENT(S)

The present invention provides an abrasive pad that is removably attachable to a driven rotatable shaft for abrading a workpiece. The abrasive pad includes a plurality of abrasive members each including an outwardly facing surface with a plurality of abrasive particles supported thereon. The abrasive members, which lie substantially within a single plane, are angularly offset to provide an extended abrasive edge surface compared to a conventional square or cross pad. Each abrasive member may comprise an abrasive strip formed into a loop having upper and lower portions, and opposing ends connecting the upper and lower portions. Each loop may further include a pair of side edges extending between the opposing ends, outwardly facing surfaces and opposing inwardly facing surfaces.

The number and arrangement of the angularly offset abrasive members may be varied to form abrasive pads suitable for different applications. Particularly preferred embodiments of the abrasive pad of the present invention include a single ply pad, a two ply pad constructed using a double thickness of abrasive material in each angularly offset member (referred to as a "double ply pad") and a two ply pad constructed by enclosing a single ply pad within a second single ply pad (referred to as a "pad within a pad"). Generally, the single ply pad is more flexible than the other pads and typically is preferred for use on contoured surfaces and for less aggressive applications such as polishing. The stiffer two ply pads generally are preferred for more aggressive applications. A pad within a pad typically is preferred for applications in which many projections extend from the workpiece because the corners of the pad are less likely to catch on these projections than the corners of the double ply pad.

Figure 1:
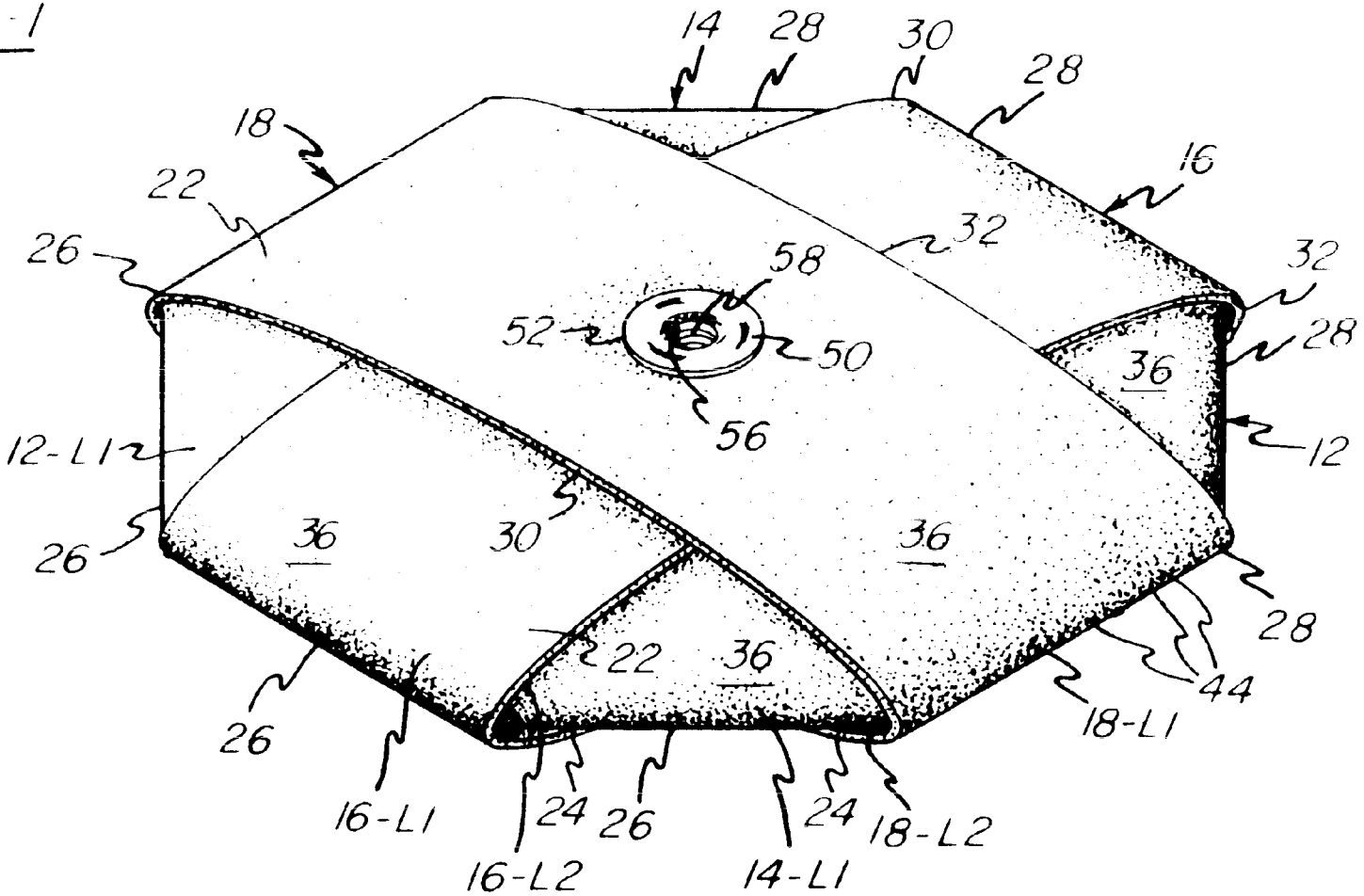
FIG. 1 is a perspective view of the abrasive pad of the present invention.
Figure 2:
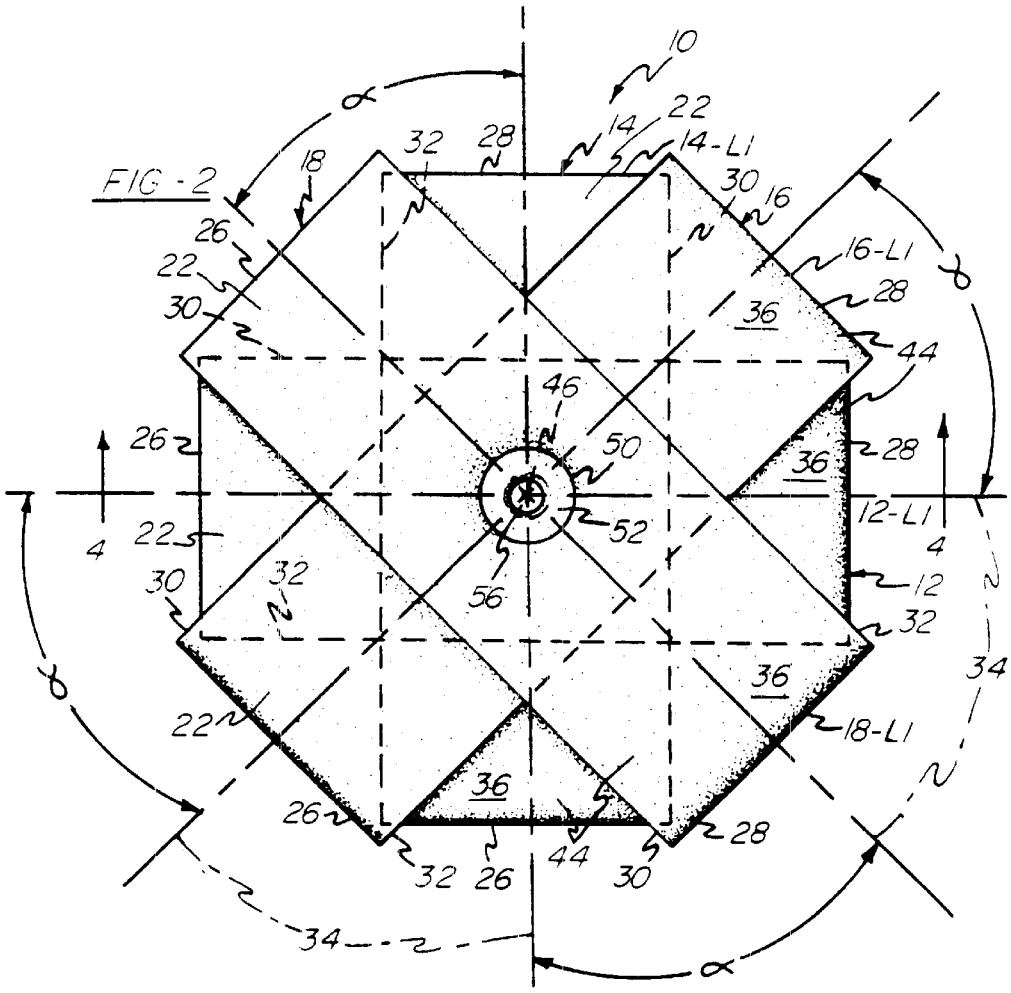
FIG. 2 is a top plan view of the abrasive pad of the present invention.

In each of the preferred embodiments, the first abrasive member is positioned substantially perpendicular to the second abrasive member, the third abrasive member is positioned angularly intermediate the first and second abrasive members, and the fourth abrasive member is positioned substantially perpendicular to the third abrasive member and angularly intermediate the first and second abrasive members. The abrasive pad formed using this arrangement of abrasive strips has a substantially octagonal perimeter, as shown in FIGS. 1 and 2. Consistent with the objects of the invention, this arrangement results in an abrasive pad that has an extended abrasive edge surface and is free from sharp corners that may impact the surface of the workpiece to be abraded.

Preferably, the abrasive pad includes a plurality of inner abrasive members and an outer abrasive member, with a portion of each of inner abrasive member received within the next outermost abrasive member. To this end, the second, third, and fourth abrasive members each are formed into a closed loop. Each loop defines a slot bounded by inwardly facing surfaces of the loop. A first abrasive member is supported centrally within the abrasive pad. The first abrasive member is positioned substantially perpendicular to the second abrasive member, with a central portion of the first abrasive member received within the loop of the second abrasive member. The third abrasive member is positioned angularly intermediate the first and second abrasive members. A central portion of each of the first and second abrasive members is received within the loop of the third abrasive member. The fourth abrasive member is positioned substantially perpendicular to the third abrasive member and angularly intermediate the first and second abrasive members. A central portion of each of the first, second and third abrasive members is received within the loop of the fourth abrasive member. The centers of all of the abrasive members are coaxially aligned. When more than four abrasive members are provided in the abrasive pad, at least a central portion of each inner member is received within the loop formed by the next outermost abrasive member until the desired number of abrasive members has been reached.

An aperture is formed proximate the center of each abrasive member and extends through the upper and lower portions of each respective loop. The aperture of each abrasive member is coaxially aligned. A connector may be received within the aperture. The connector may assist in securing the plurality of abrasive members together and/or aid in engaging an output shaft of a rotary tool. The connector may be an internally threaded rivet that includes an upper flange for engaging the upper portion of the fourth abrasive member and lower crimping fingers for engaging the lower portion of the fourth abrasive member. The connector may include internal threads for engaging an output shaft of a rotary tool.

Figure 3:
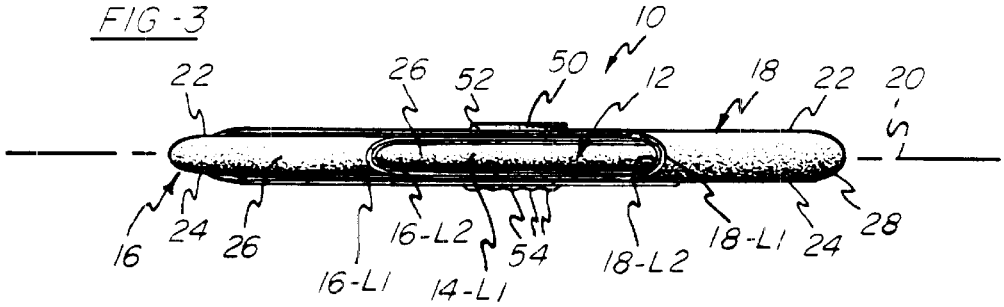
FIG. 3 is a side elevational view of the abrasive pad of the present invention.

The abrasive pad of the present invention is described and illustrated with particular reference to the double ply embodiment. Referring initially to FIGS. 1–5, the abrasive pad 10 of the present invention includes a plurality of angularly offset abrasive members that lie substantially within a single plane 20 (FIG. 3). Each abrasive member 12, 14, 16, 18 preferably comprises a pair of loops, each loop generally designated by reference letter L in combination with a number. Each loop L1 and L2 includes upper and lower portions 22 and 24 connected by a pair of opposing ends 26 and 28. In the following discussion, the loops L1 and L2 of each abrasive member 12, 14, 16, 18 are indicated as a suffix of the reference numeral for the corresponding abrasive member, such as 12-L1, 12-L2, 14-L1, etc.

Figure 5:
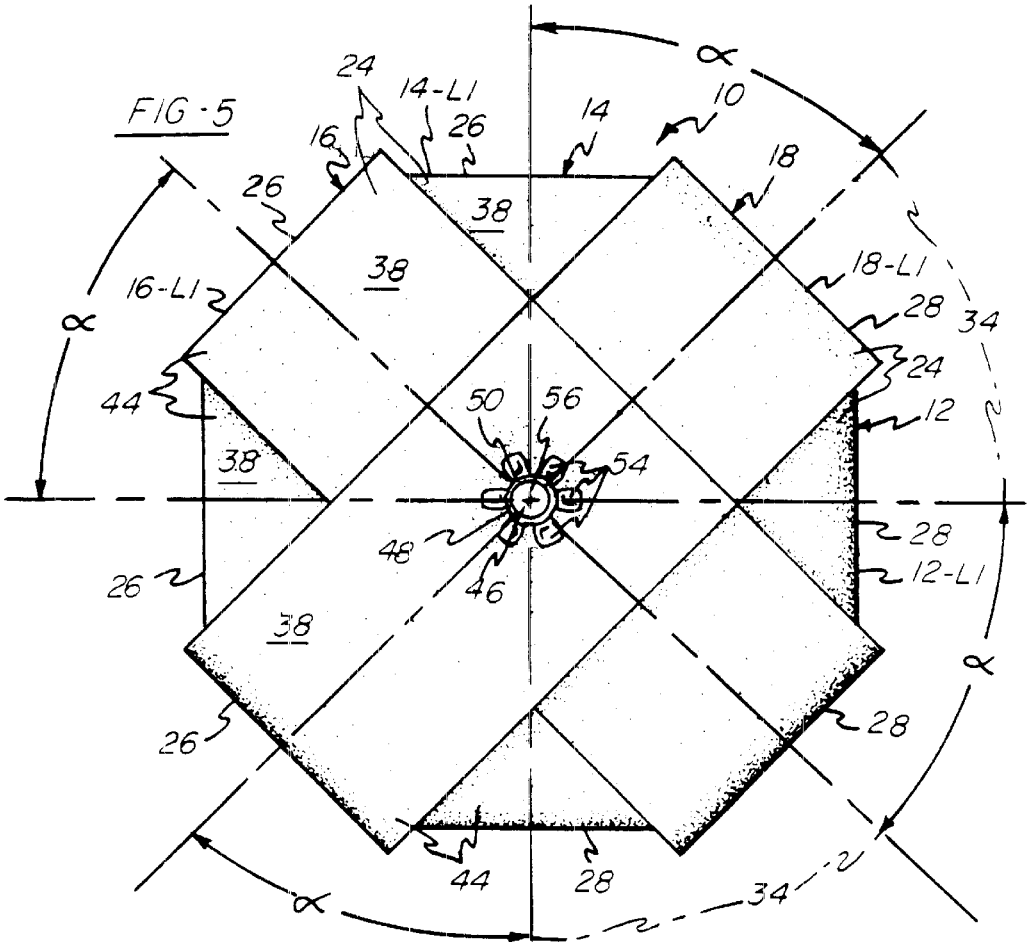
FIG. 5 is a bottom plan view of the abrasive pad of the present invention.

A pair of side edges 30 and 32 extend longitudinally between the opposing ends 26 and 28 of each loop L, wherein a longitudinal axis 34 extends between, and parallel to, the side edges 30 and 32 (FIGS. 2 and 5). The upper and lower portions 22 and 24 of each loop L include outwardly facing surfaces 36 and 38 and a pair of opposed inwardly facing surfaces 40 and 42.

The outwardly facing surfaces 36 and 38 support a plurality of abrasive particles 44. Each loop L1 and L2 is preferably formed from an abrasive strip generally designated by the reference letter S in combination with a reference numeral. In the illustrated embodiment, each loop L1 and L2 includes an abrasive strip S1 and S2, respectively. In the following discussion, the particular abrasive strip S1, S2 of each abrasive member 12, 14, 16, 18 is indicated as a suffix of the abrasive member, such as 12-S1, L2-S2, etc.

Abrasive strips S1, S2 of each loop L1, L2 are coaxially aligned in an overlapping relationship. Moreover, the abrasive strips S1, S2 are arranged such that the outwardly facing surfaces 36 and 38 of each loop L2 contact the inwardly facing surfaces 40 and 42 of the loop L1 (FIG. 4) within each abrasive member 12, 14, 16, 18. It may be appreciated that by having multiple aligned and overlapping abrasive strips S1, S2, additional abrasive surfaces 36 and 38 are provided as each successive strip S1 is worn away during an abrading operation.

The abrasive strips S1, S2 of the present invention preferably comprise either a coated abrasive or a nonwoven abrasive. The former includes a backing (e.g., cloth, paper, vulcanized fiber, or polymeric film) with abrasive particles 44 bonded thereto by one or more binder coats of resin or glue. Nonwoven abrasives include a substrate, which may be a porous, fibrous, nonwoven construction and an abrasive comprising individual abrasive particles on one side of the substrate. The substrate must be capable of wearing away during use of the abrasive pad 10 to expose fresh abrasive on inner layers of the pad. Cotton is a preferred substrate, although other suitable substrates also may be used. The particles 44 may be made of material such as fused aluminum oxide, ceramic aluminum oxide, heated treated aluminum oxide, silicon carbide, or any other abrading means known in the art. For example, an abrasive strip S sold by Minnesota Mining and Manufacturing Company of St. Paul, Minn. may be used in constructing the abrasive pad 10 of the present invention. The grit size of the particles may be selected based on the characteristics of the workpiece. Coarser grits typically are used for removing larger amounts of material from the workpiece and finer grits typically are used for removing smaller amounts of material from the workpiece or polishing the workpiece surface.

As illustrated in FIGS. 1, 2 and 5, each abrasive member is angularly offset from radially adjacent abrasive members L. In the preferred embodiment, the four abrasive members 12, 14, 16, 18 each have a longitudinal axis 34 offset from adjacent longitudinal axes 34 by a constant angle $\alpha$ (FIGS. 2 and 5). In the embodiment illustrated, this angle of is equal to approximately 45°. The ends 26 and 28 of each loop L lies substantially within the single plane 20 (FIG. 3).

Figure 18:
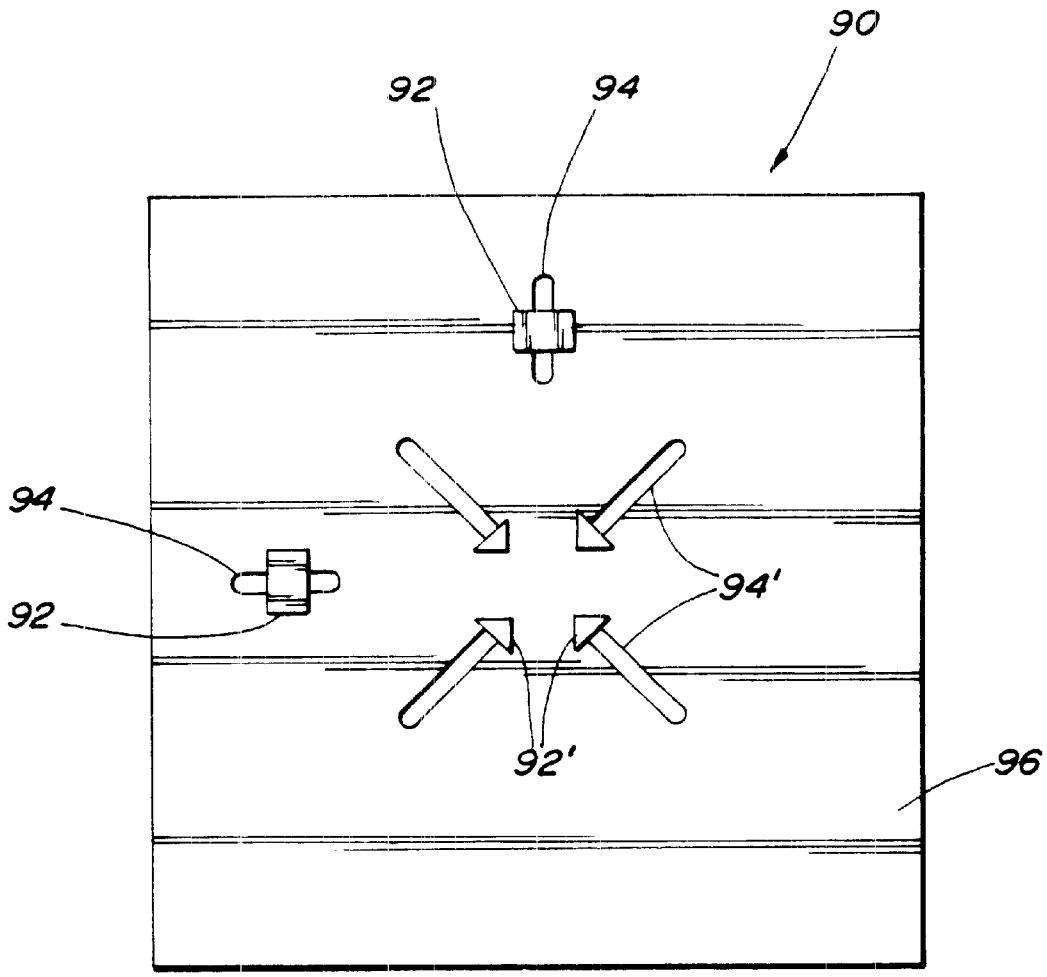
FIG. 18 is a diagrammatical top plan of a template useful in making the abrasive pad of the present invention.

Preferably, a template 90 (FIG. 18) is used to align the abrasive members 12, 14, 16, 18. The template 90 may include end 92 or angular 92' stops defining the desired angle $\alpha$ between the strips and at least one end of each strip. The stops 92, 92' may be fasteners inserted through slots 94, 94' or pins inserted into bores in the working surface 96 of the template so the stop position may be adjusted to accommodate abrasive pads of different sizes.

Figure 4:
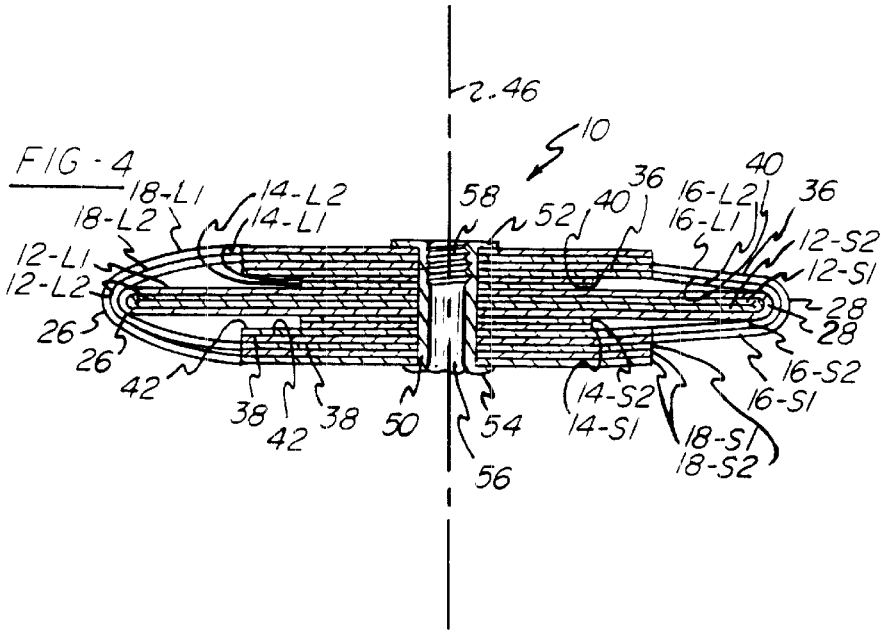
FIG. 4 is a cross-sectional view taken along line 4—4 in FIG. 2.

Referring to FIGS. 2–4, the loops 14-L1 and 14-L2 of the second abrasive member 14 are positioned substantially perpendicular to the loops 12-L1 and 12-L2 of the first abrasive member 12. Moreover, the centers 46 of the first and second abrasive members 12 and 14 are substantially coaxially aligned wherein the loops 12-L1 and 12-L2 of the first abrasive member 12 are partially received intermediate the opposed inwardly facing surfaces 40 and 42 of the loops 14-L1 and 14-L2 of the second abrasive member 14. The center 46 of each abrasive member 12, 14, 16 and 18 is defined to be centrally located in a longitudinal direction between the opposing ends 26 and 28 of its respective loops L1 and L2 and in a lateral direction between the side edges 30 and 32 of its respective loops L1 and L2.

The loops 16-L1 and 16-L2 of the third abrasive member 16 are positioned angularly intermediate, preferably at 45°, the loops 12-L1 and 12-L2 and 14-L1 and 14-L2 of the first and second abrasive members 12 and 14. The center 46 of the third abrasive member 16 is axially aligned with the centers 46 of the first and second abrasive members 12 and 14. As such, the loops 12-L1 and 12-L2 and 14-L1 and 14-L2 of the first and second abrasive members 12 and 14 are partially received intermediate the opposed inwardly facing surfaces 40 and 42 of the loop 16-L2 of the third abrasive member 16. Additionally, the outwardly facing surfaces 36 and 38 of the loop 14-L1 partially contacts the inwardly facing surfaces 40 and 42 of the loop 16-L2. The opposing ends 26, 28 of the third abrasive member 16 partially overlap the opposing ends 26, 28 of the first 12 and second 14 abrasive members.

The loops 18-L1 and 18-L2 of the fourth abrasive member 18 are positioned substantially perpendicular to the loops 16-L1 and 16-L2 of the third abrasive member 16 and angularly intermediate, preferably at 45°, the loops 12-L1 and 12-L2 and 14-L1 and 14-L2 of the first and second abrasive members 12 and 14. Again, the center 46 of the fourth abrasive member 18 is coaxially aligned with the centers 46 of the first, second and third abrasive members 12, 14 and 16 such that the first, second and third abrasive members 12, 14, 16 are partially received intermediate the opposing inwardly facing surfaces 40 and 42 of the loop 18-L2 of the fourth abrasive member 18. The outwardly facing surfaces 36 and 38 of the loop 16-L1 partially contacts the inwardly facing surfaces 40 and 42 of the loop 18-L2.

It should be appreciated that a distance d1 between the opposing ends 26 and 28 of the first abrasive member 12 is less than a distance d3 between the opposing ends 26 and 28 of the third abrasive member 16. Likewise, the distance d1 between the opposing ends 26 and 28 of the first abrasive member 12 is substantially equal to a distance d2 between the opposing ends 26 and 28 of the second abrasive member 14. A distance 0 between the opposing ends 26 and 28 of the third abrasive member 16 is substantially equal to a distance d4 between the opposing ends 26 and 28 of the fourth abrasive member 18. As illustrated in FIG. 2, the opposing ends 26 and 28 of the loops 16-L1 and 16-L2 and 18-L1 and 18-L2 of the third and fourth abrasive members 16 and 18 partially overlap the opposing ends 26 and 28 of the loops 12-L1 and 12-L2 and 14-L1 and 14-L2 of both the first and second abrasive members 12 and 14. More particularly, it can be seen that the side edges 30 and 32 of the loops 16-L1 and 16-L2 and 18-L1 and 18-L2 of the third and fourth abrasive members 16 and 18 intersect the opposing ends 26 and 28 of the loops 12-L1 and 12-L2 and 14-L1 and 14-L2 of the first and second abrasive members 12 and 14.

An aperture 48 is formed proximate the center 46 of each loop L1 and L2 through both the upper and lower portions 22 and 24. A connector 50 may be received within the aperture 48. The connector 50 may include an upper flange 52 and a plurality of radially outwardly extending fingers 54. The combination of the flange 52 and fingers 54 serves to clamp the plurality of abrasive members 12, 14, 16 and 18 together in a secured relationship. The connector 50 also may include a through bore 56 having a plurality of internal threads 58 (FIG. 4) to facilitate a removable connection of the abrasive pad 10 to the output shaft of a rotary tool (not shown).

The single ply embodiment of the present invention has the same attributes as the previously described double ply embodiment except that the abrasive members each comprise a single loop. The joints may at the ends of the loops preferably are overlapping rather than butt joints to reinforce the central portion of the pad where the aperture will be formed, although a single ply pad also can be formed using butt joints.

The pad within a pad embodiment of the present invention generally has the same attributes as the single ply embodiment except that the pad further includes abrasive members formed into an outer single ply pad that encloses an inner single ply pad. Fifth, sixth, seventh and eighth abrasive members correspond to first, second, third and fourth abrasive members of the outer pad. Preferably, the innermost abrasive member of the outer pad is angularly offset at an angle of about 45° from the outermost abrasive member of the inner pad, i.e., the fifth abrasive member is coaxially aligned with and in substantially overlapping relation to either the first or second abrasive member of the inner pad.

As with the second, third and fourth abrasive members of the inner pad, each abrasive member of the outer pad is formed into a loop that defines a slot bounded by the inner surfaces of the loop. In a pad having an inner pads with four abrasive members, the fifth abrasive member is positioned angularly adjacent to the fourth abrasive member and at least a central portion of each of the first, second, third and fourth abrasive members is received within the loop of the fifth abrasive member. The sixth abrasive member is positioned substantially perpendicular to the fifth abrasive member. At least a central portion of each of the first through fifth abrasive members is received within the loop of the sixth abrasive member. The seventh abrasive member is positioned angularly intermediate the fifth and sixth abrasive members. At least a central portion of each of the first through sixth abrasive members is received within the loop of the seventh abrasive member. The eighth abrasive member is positioned substantially perpendicular to the seventh abrasive member and angularly intermediate the fifth and sixth abrasive members. At least a central portion of each of the first through seventh abrasive members is received within the loop of the eighth abrasive member. Preferably, the joints at the ends of the loops formed by the inner abrasive members are butt joints to avoid excess bulk in the central portion of the pad and the joint at the end of the loop formed by the outermost abrasive member is an overlapping joint as described in connection with the double ply embodiment.

The present invention also provides a method for making the abrasive pad of the present invention including the steps of providing first, second, third and fourth members each having an outwardly facing surface with a plurality of abrasive particles supported thereon. The abrasive members each may comprise an abrasive strip formed into a loop having upper and lower portions, and opposing ends connecting the upper and lower portions. Each loop may further include a pair of side edges extending between the opposing ends, outwardly facing surfaces and opposing inwardly facing surfaces.

The first strip may be folded into a first loop wherein the lower surface defines a pair of outwardly facing abrasive surfaces, the upper surface defines a pair of opposed inwardly facing surfaces, and a pair of end edges connect each pair of outwardly and inwardly facing surfaces.

The second strip is positioned in angularly offset relation to the first loop and intermediate the pair of end edges of the first loop, wherein a portion of the upper surface of the second strip engages a portion of one of the outwardly facing surfaces of the first loop. The second strip is folded into a second loop wherein the lower surface defines a pair of outwardly facing abrasive surfaces, the upper surface defines a pair of opposed inwardly facing surfaces, a pair of end edges connect each pair of outwardly and inwardly facing surfaces, and the first loop is partially received intermediate the opposed inwardly facing surfaces of the second loop.

The third strip is positioned in angularly offset relation to the first and second loops wherein a portion of the upper surface of the third strip engages a portion of one of the outwardly facing surfaces of at least one of the first and second loops. The third strip is folded into a third loop wherein the lower surface of the third strip defines a pair of outwardly facing abrasive surfaces, the upper surface defines a pair of opposed inwardly facing surfaces, a pair of end edges connect each pair of outwardly and inwardly facing surfaces, and the first and second loops are partially received intermediate the opposed inwardly facing surfaces of the third loop.

The fourth strip is positioned in angularly offset relation to the first and second loops wherein a portion of the upper surface of the fourth strip engages a portion of one of the outwardly facing surfaces of the third loop. The fourth strip is folded into a fourth loop wherein the lower surface of the fourth strip defines a pair of outwardly facing abrasive surfaces, the upper surface defines a pair of opposed inwardly facing surfaces, a pair of end edges connect each pair of outwardly and inwardly facing surfaces, and the first, second and third loops are partially received intermediate the opposed inwardly facing surfaces of the fourth loop.

The method further comprises the step of forming an aperture through the loops intermediate the end edges thereof. A connector may be passed through the aperture.

Turning now to FIGS. 6–17, the method of manufacturing the double ply embodiment of the abrasive pad 10 will be described in greater detail. Initially, a plurality of abrasive strips S1, S2 are cut to a desired width and length for use within the abrasive pad 10. Preferably, the width w of the strips is selected to satisfy the relationship:

$$w=(\pi \times D)/8,$$

D is the desired diameter of the pad, to reduce irregularities on the edges of the finished pad, which in turn will reduce catching of the pad on a workpiece.

The individual abrasive strips S may be of the type described in detail above. More particularly, each abrasive strip S includes first, or upper, and second, or lower, surfaces 60 and 62 with abrasive 44 disposed on the lower surface 62. Each abrasive strip further includes a pair of end edges 64 and 66.

It may be readily appreciated that the loop L1 formed by each outside abrasive strip S1 will be longer than the loop L2 formed by each inside abrasive strip S2. As such, the first strip S1 is cut to a shorter length than the second strip S2 for each pair of loops L of an abrasive member 12, 14, 16 and 18. For illustrative purposes, the following Table I may be used when producing an abrading pad 10 having a distance D between opposing ends 26 and 28 of the third and fourth abrasive members 16 and 18 of approximately four inches.

TABLE I

Representative Dimensions for a Four (4) Inch Abrasive Pad

| Abrasive Strip No. | Strip Width | Strip Length |
|---|---|---|
| 12-S1 | 1.75 inches | 7.25 inches |
| 12-S2 | 1.75 inches | 7.438 inches |
| 14-S1 | 1.75 inches | 7.25 inches |
| 14-S2 | 1.75 inches | 7.438 inches |
| 16-S1 | 1.75 inches | 7.875 inches |
| 16-S2 | 1.75 inches | 8.063 inches |
| 18-S1 | 1.75 inches | 7.875 inches |
| 18-S2 | 1.75 inches | 9.75 inches |

The following Table II may be used when producing an abrading pad 10 having a distance D between opposing ends 26 and 28 of the third and fourth abrasive members 16 and 18 of approximately five inches. However, it should be appreciated that abrading pads 10 of various sizes may be likewise produced using the method of the present invention. The particular size or dimensions of the abrading pad 10 in no way limits the scope of the invention.

TABLE II

Representative Dimensions for a Five (5) Inch Abrasive Pad

| Abrasive Strip No. | Strip Width | Strip Length |
|---|---|---|
| 12-S1 | 2 inches | 9.438 inches |
| 12-S2 | 2 inches | 9.625 inches |
| 14-S1 | 2 inches | 9.438 inches |
| 14-S2 | 2 inches | 9.625 inches |
| 16-S1 | 2 inches | 9.875 inches |
| 16-S2 | 2 inches | 10.125 inches |
| 18-S1 | 2 inches | 9.875 inches |
| 18-S2 | 2 inches | 12.063 inches |

Figure 6:
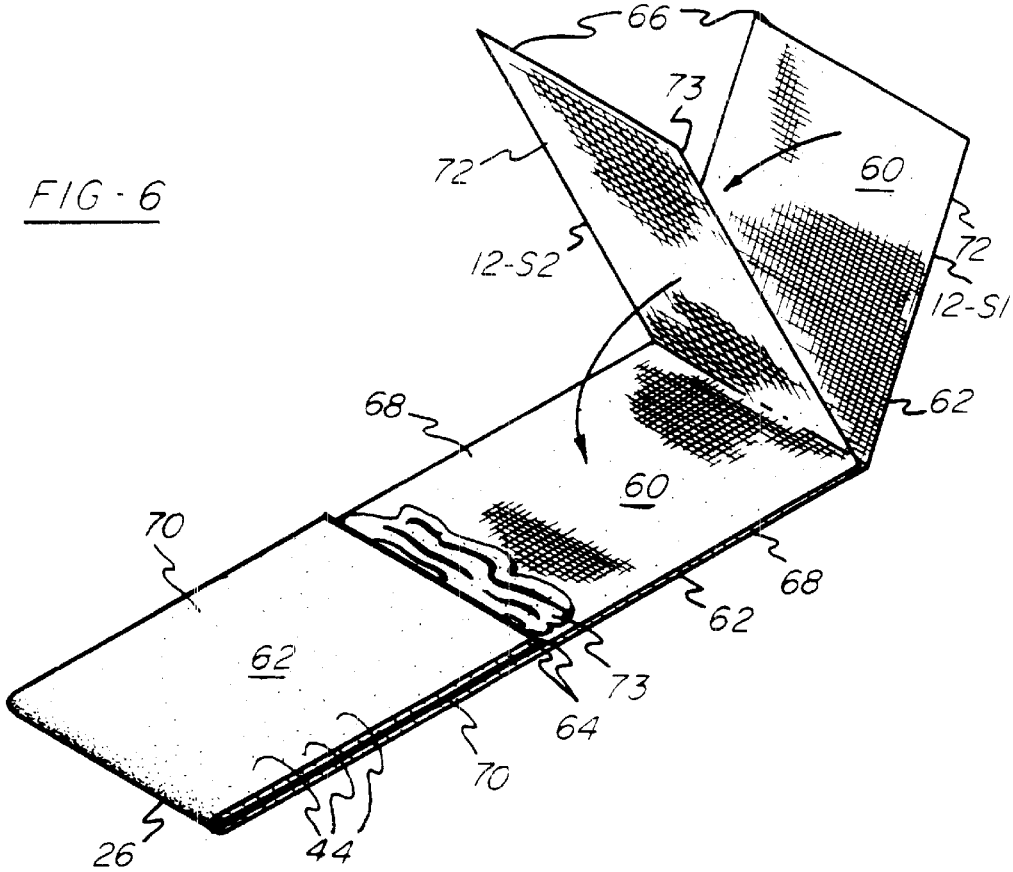
FIG. 6 is a perspective view illustrating a first series of steps of the method of the present invention.
Figure 7:
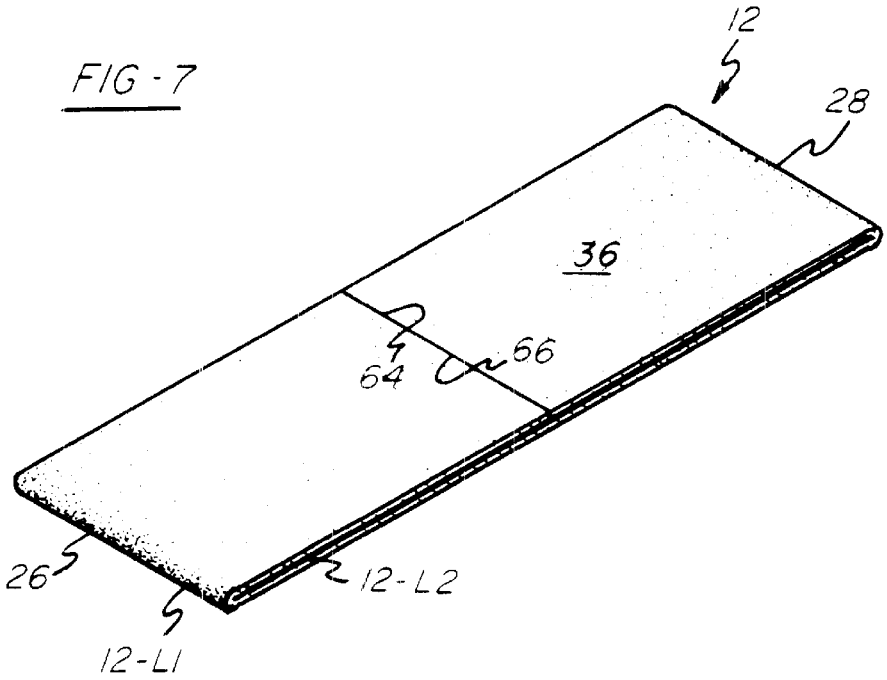
FIG. 7 is a perspective view of a completed first loop of the present invention.

Referring further to FIG. 6, strips 12-S1 and 12-S2 are folded into three portions 68, 70 and 72 wherein the first portion 68 is approximately twice the length of the second and third portions 70 and 72, and the second and third portions 70 and 72 are of substantially equal length. A breaker bar may be used to aid in folding the strips. The second and third portions 70 and 72 of strip 12-S2 are then secured by hot glue 73 or similar adhesive, proximate the center of the first portion 60 such that the lower surface 62 defines the outwardly facing surfaces 36 and 38 having abrasive 44 disposed thereon. Likewise, strip 12-S1 is wrapped around strip 12-S2 and the second and third portions 70 and 72 are glued proximate the center thereof to the outer abrasive surfaces 36 and 38 of newly formed loop 12-L2. The resulting first pair of loops 12-L1 and 12-L2 is illustrated in FIG. 7.

Figure 8:
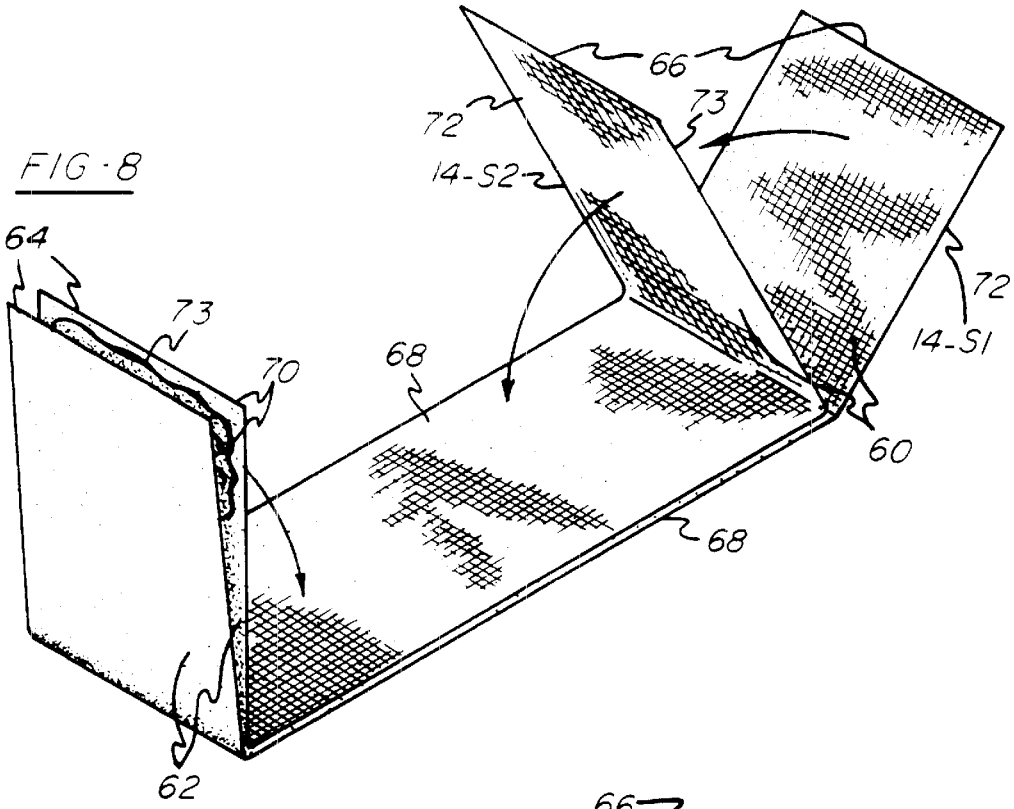
FIG. 8 is a perspective view illustrating a second series of steps of the method of the present invention.
Figure 9:
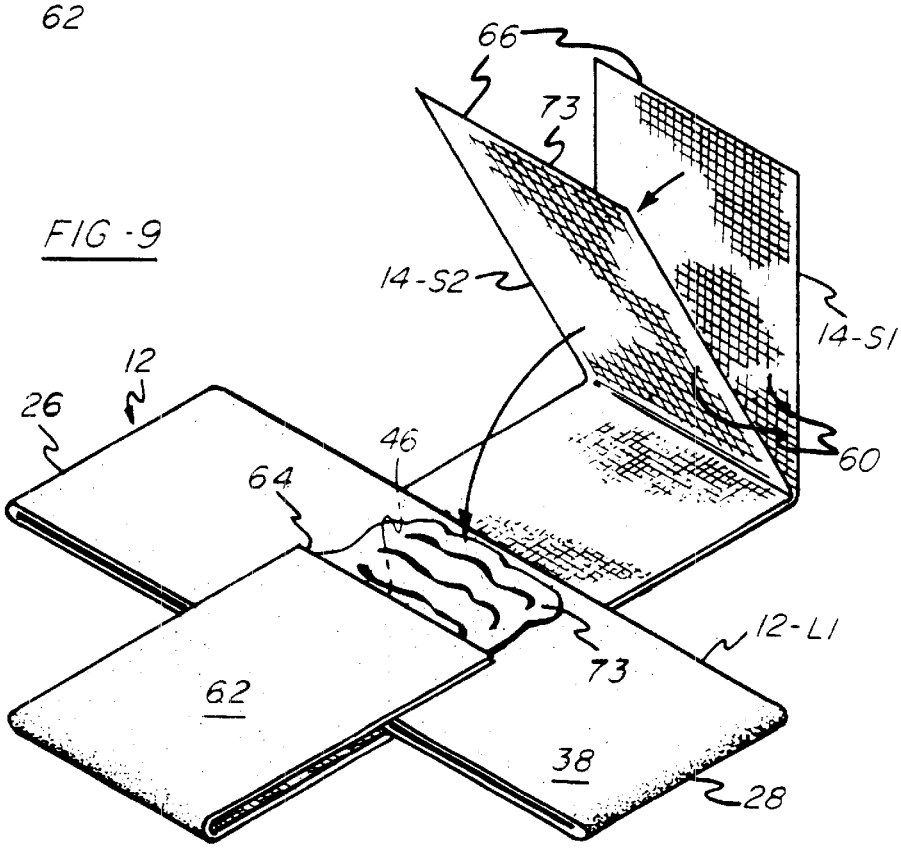
FIG. 9 is a perspective view illustrating a third series of steps of the method of the present invention.
Figure 10:
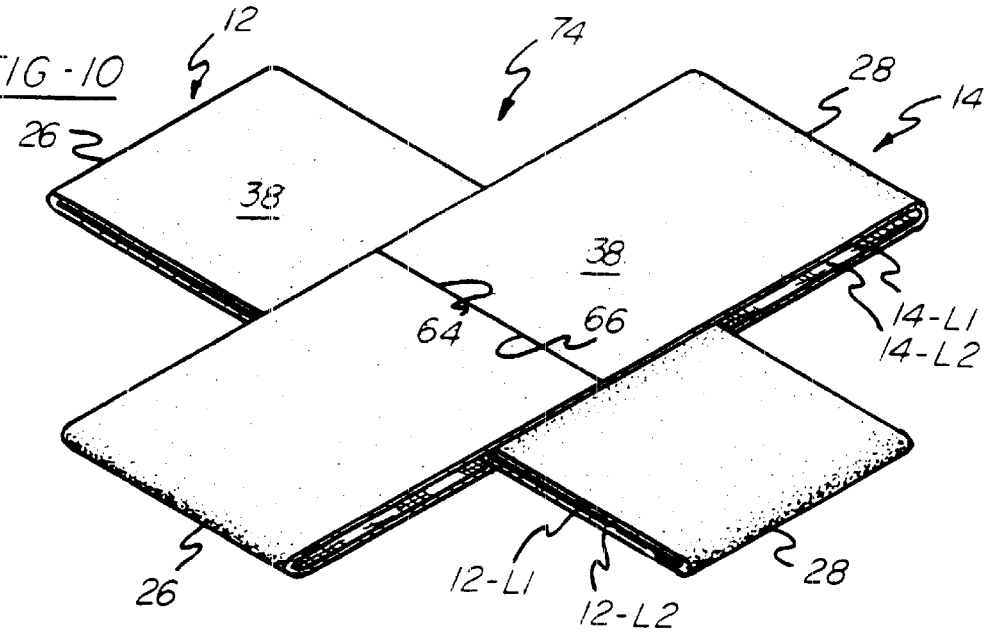
FIG. 10 is a perspective view illustrating a secured assembly of first and second loops of the present invention.

Turning now to FIGS. 8 and 9, a second set of abrasive strips 14-S1 and 14-S2 are folded into three portions 68, 70 and 72 as described above with respect to abrasive strips 12-S1 and 12-S2. Hot glue 73, or similar adhesive, is placed proximate the edges 64 and 66 of the abrasive strip 14-S2 on the lower surface 62 thereof and the abrasive strip 14-S1 is brought in contact therewith to secure the strips 14-S1 and 14-S2 together. As illustrated in FIG. 9, the second set of strips 14-S1 and 14-S2 are positioned intermediate the newly formed ends 26 and 28 of the abrasive loops 14-L1 and 14-L2. The center 46 of the first loop 14-L1 is positioned to be coaxially aligned with the center 46 of the newly formed second loop 16-L. Hot melt 73 is preferably placed on the outer surface 38 of the first loop 12-L1 proximate the center 46 and the ends 64 and 66 of the abrasive strip 14-S2 are brought into contact therewith for securing loops 14-L1 and 14-L2 and 12-L1 and 12-L2 together. The resulting assembly 74 of first and second loops is illustrated in FIG. 10.

Alternatively, strip 14-S2 may be wrapped around the first loops 12-L1 and 12-L2 at approximately a 90° angle thereto such that its ends 64, 66 overlap the opposing ends 26 and 28 of the first loops 12-L1 and 12-L2. The ends 64, 66 may be secured to the outer surface of loop 12-L1 to form loop 14-L2. A first end 64 of abrasive strip 14-S1 may then be secured to the strip 16-S2 and wrapped in alignment therewith over the first loops 12-L1 and 12-L2. The second end 66 of the strip 14-S1 may then be secured to the strip 14-S2.

Figure 11:
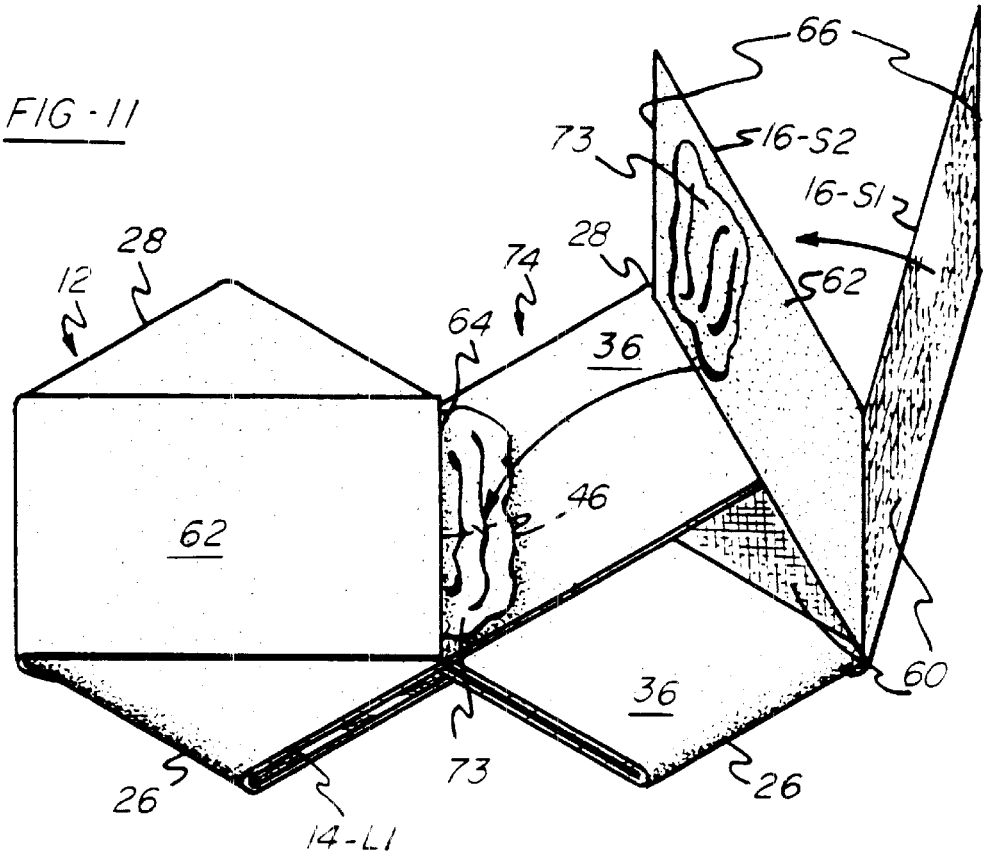
FIG. 11 illustrates a fourth series of steps of the method of the present invention.
Figure 12:
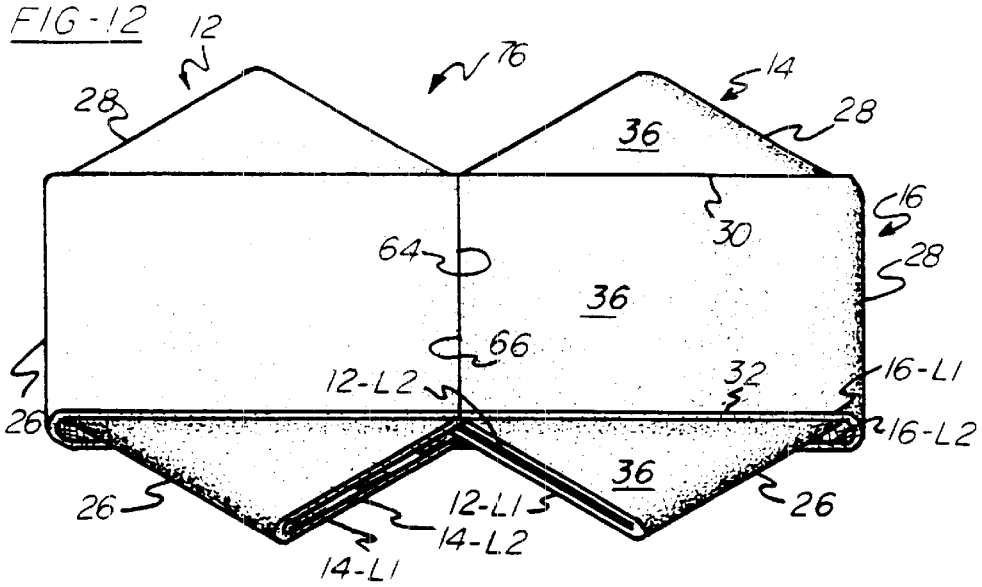
FIG. 12 is a perspective view illustrating a secured assembly of first, second and third loops of abrasive strips.

Turning now to FIGS. 11 and 12, the next step of the method of the present invention involves wrapping abrasive strips 16-S1 and 16-S2 around the assembly 74 of first and second loops. Strip 16-S2 is initially wrapped around the assembly 74 at approximately a 45° angle to both the first and second loops 12-L1, 12-L2 and 14-L1, 14-L2 such that its side edges 30 and 32 overlap the opposing ends 26 and 28 of both the first and second loops 12-L1, 12-L2 and 14-L1, 14-L2. More particularly, hot melt 73, or similar adhesive, is placed on the outer surface 36 of loop 14-L1 near the center 46 and the edges 64 and 66 of abrasive strip 16-S2 is secured thereto thereby forming loop 16-L2. The first abrasive strip 16-S1 next has its first end 64 secured to the strip 16-S2 by hot glue 73 and wrapped in alignment therewith over the assembly 74. The second end 66 of the strip 16-S1 is then secured by hot melt 73 to the strip 16-S2. The resulting assembly 76 of first, second and third loops is illustrated in FIG. 12. Alternatively, strips 16-S2 and 16-S1 may be adhered together and affixed as a unit to loop 14-L1.

Figure 13:
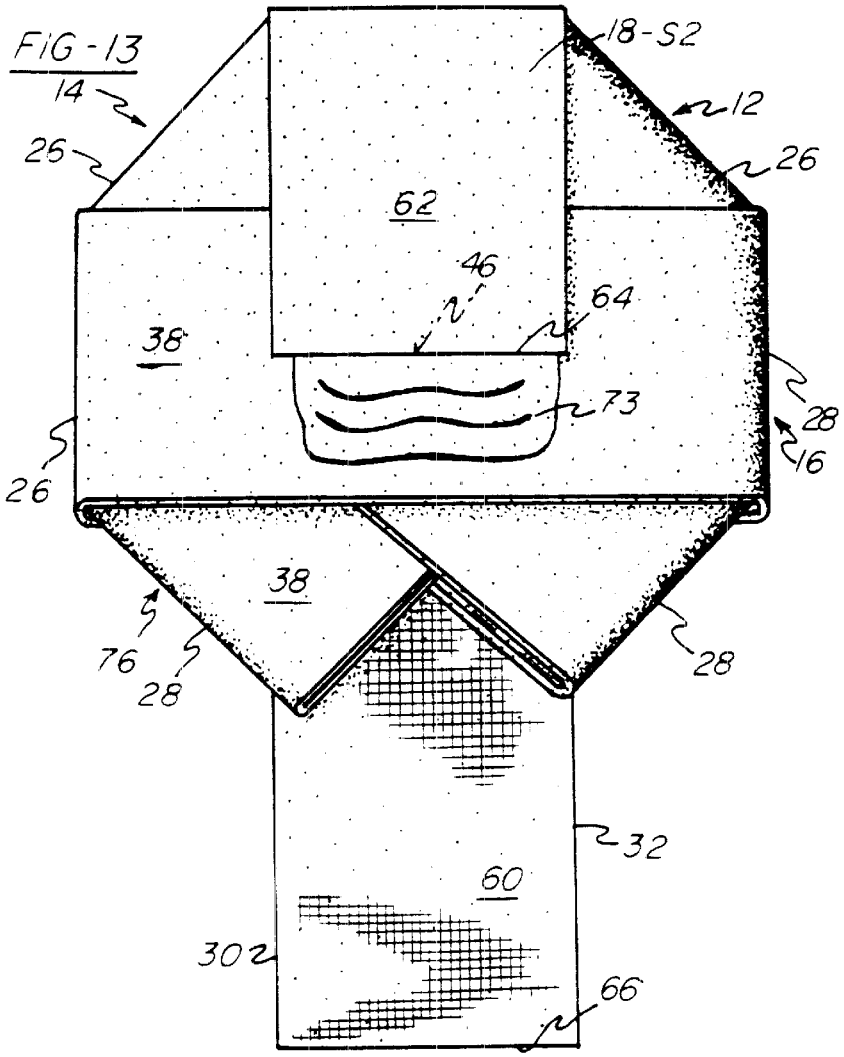
FIGS. 13 through 16 are top plan views illustrating a fifth series of steps of the method of the present invention.
Figure 14:
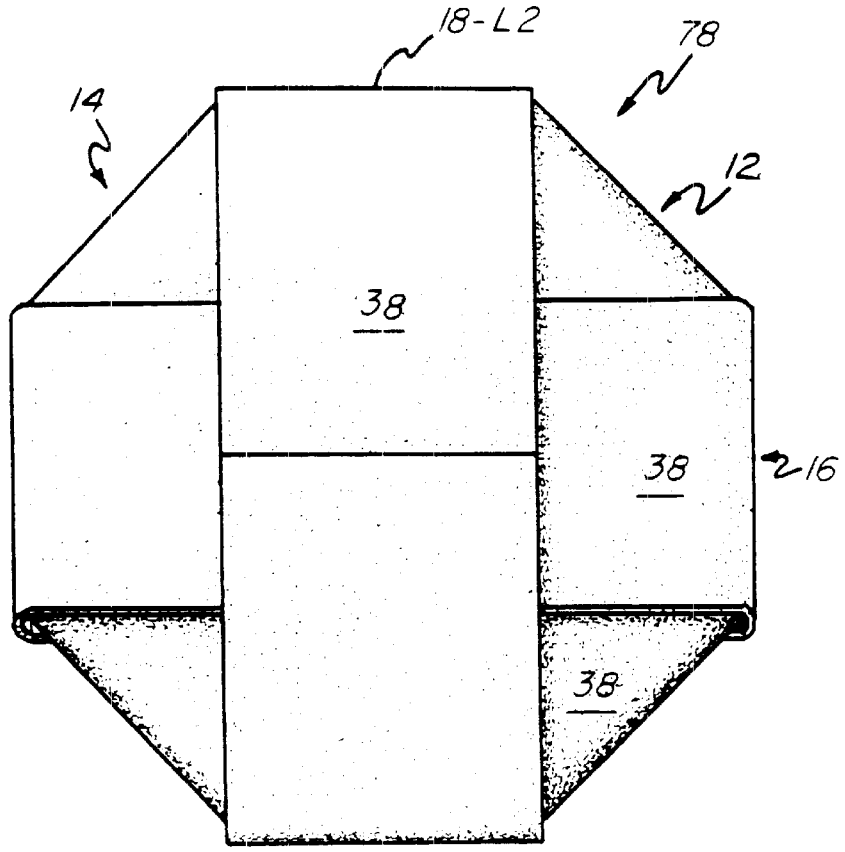

Turning now to FIGS. 13 and 14, the next series of steps involve wrapping abrasive strip 18-S2 around the assembly 76 angularly intermediate the first and second loops 12-L1, 12-L2 and 14-L1, 14-L2, and substantially perpendicular to the third loop 16-L1. More particularly, a first end 64 of abrasive strip 18-S2 is secured to the outwardly facing surface 38 of the third loop 16-L1 by hot melt 73, or similar adhesive. The abrasive strip 18-S2 is then wrapped around the assembly 76 such that its side edges 30 and 32 intersect and overlap the opposing ends 26 and 28 of the first and second loops 12-L1, 12-L2 and 14-L1, 14-L2. The end 66 of the abrasive strip 18-S2 is then secured to the third abrasive member 16 using hot melt 73. The resulting assembly 78 is illustrated in FIG. 14. Alternatively, strips 18-S2 and 18-S1 may be adhered together and affixed as a unit to loop 16-L1.

Figure 15:
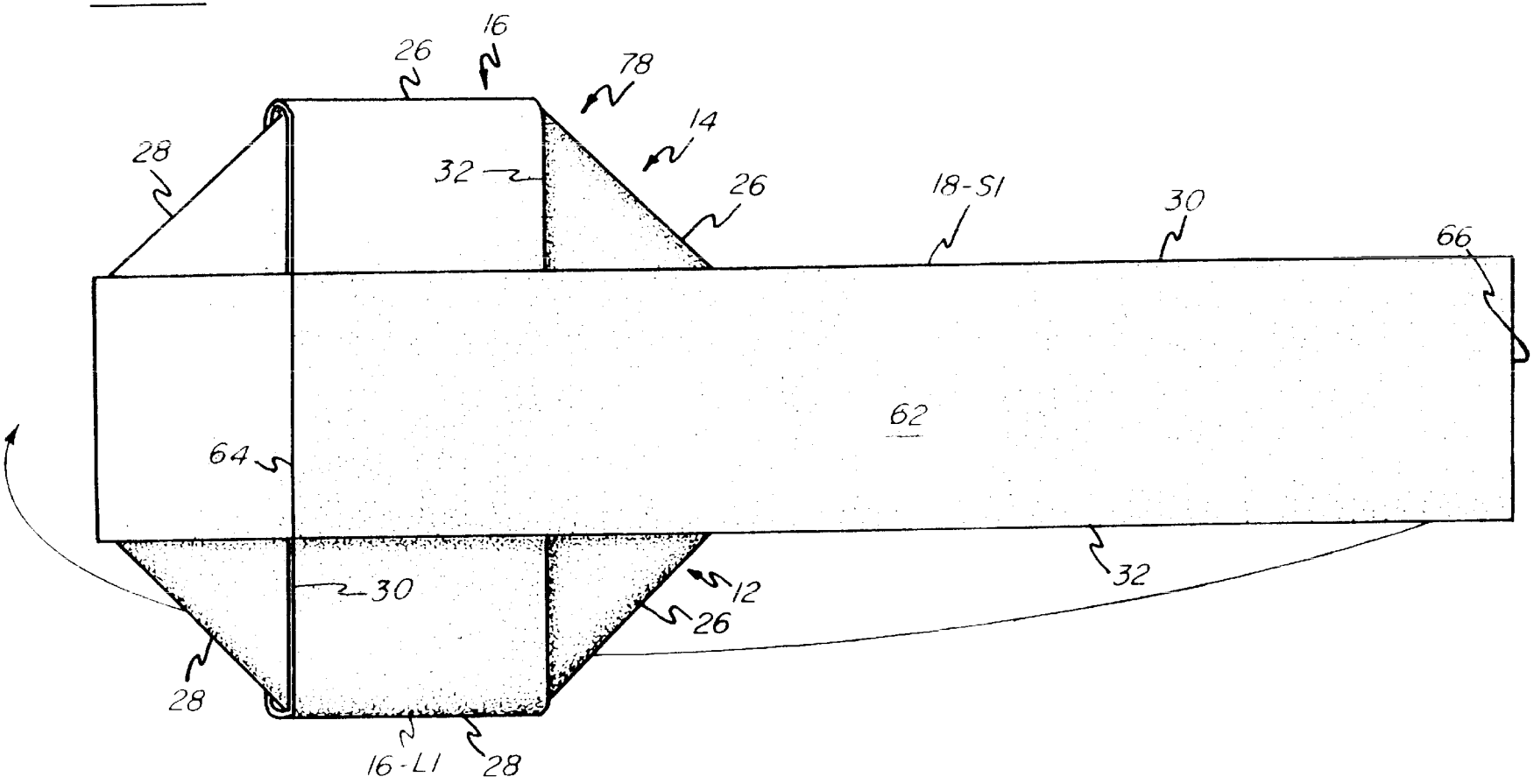
Figure 16:
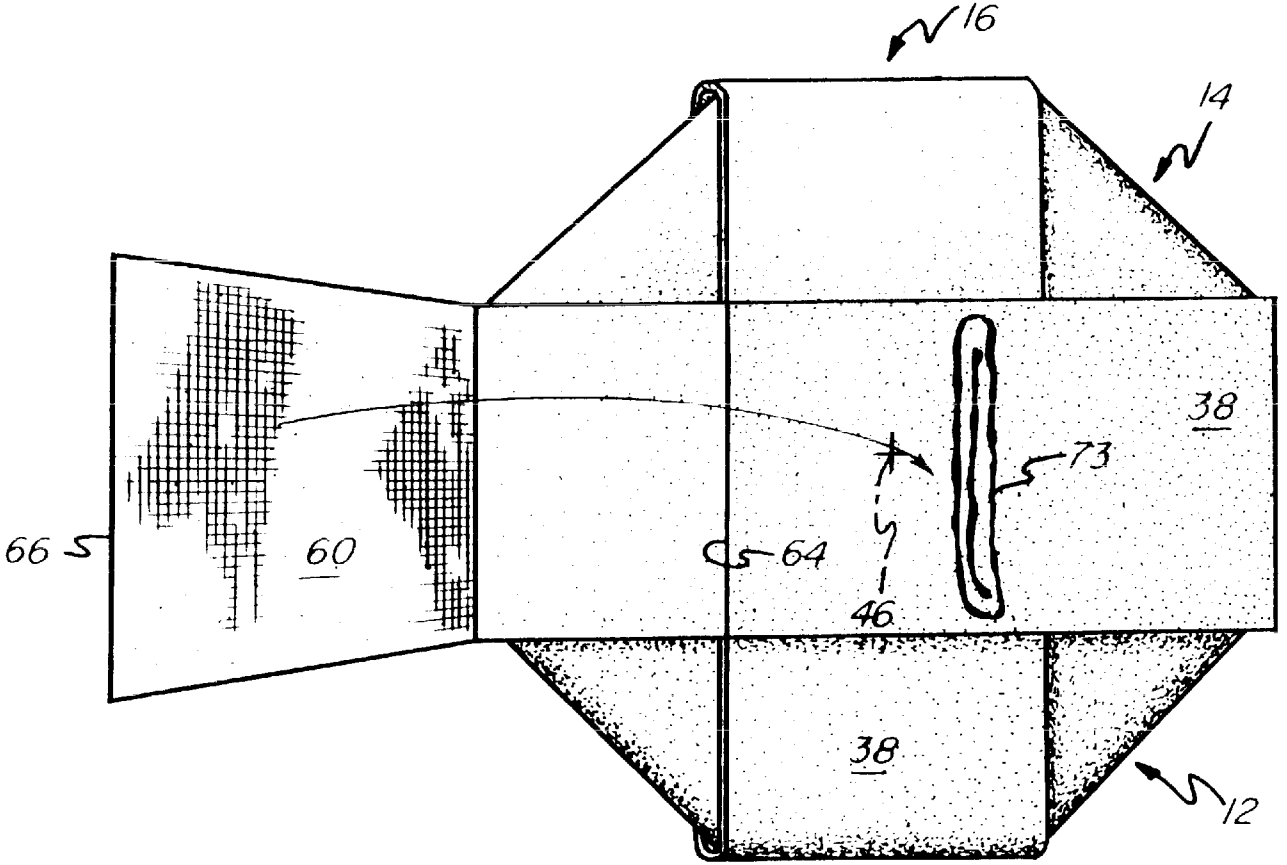
Figure 17:
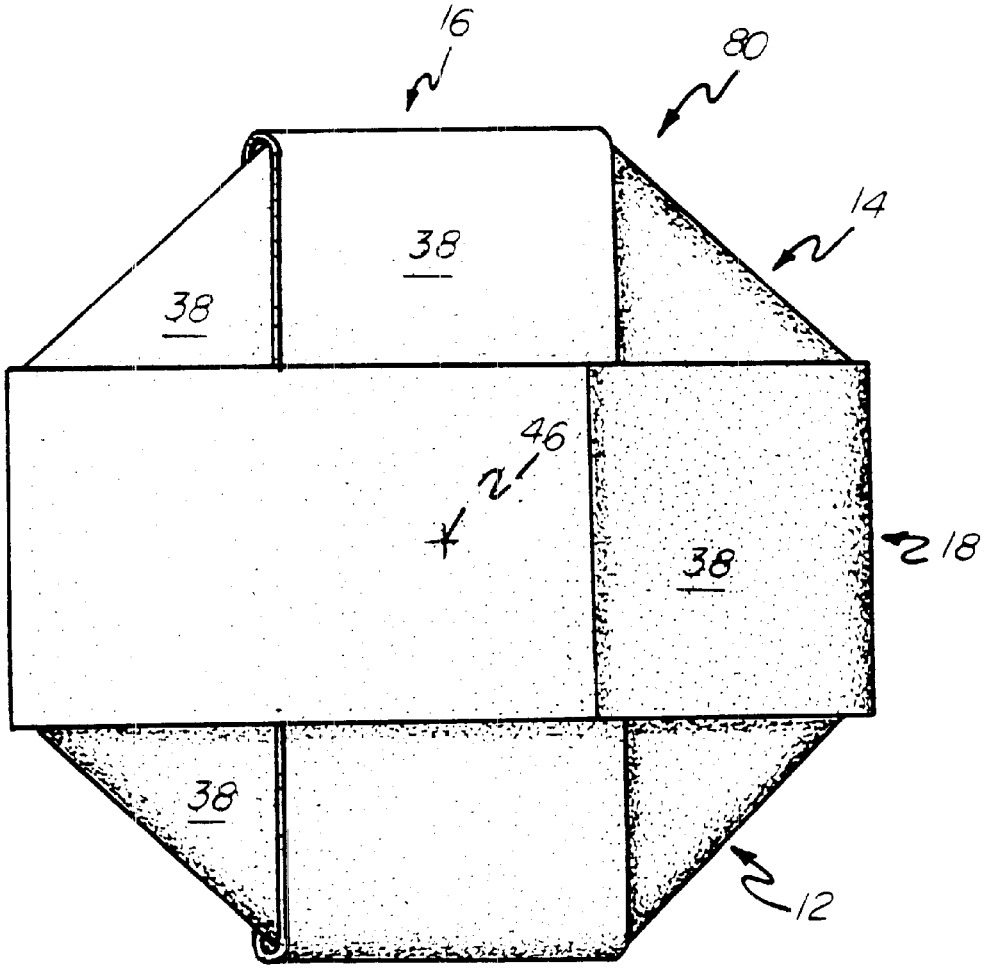
FIG. 17 is a top plan view illustrating a secured assembly of first, second, third and fourth loops of abrasive strips.

The next series of steps of the method of the present invention is illustrated in FIGS. 15 and 16 wherein the abrasive strip 18-S1 has its first end 64 secured by hot melt 73, or other adhesive, in alignment with a side edge 32 of the third loop L6-L1. The abrasive strip 18-S1 is then wrapped around the abrasive member 18-S2 in alignment therewith. The end 66 of abrasive strip 18-S1 is then secured to the outwardly facing surface 38 of the abrasive strip 18-S2 by adhesive. It should be noted that the edge of the abrasive member 18-S1 passes beyond the center point 46 of the other abrasive members 12, 14, and 16 to provide added stability for the aperture which is formed in a subsequent step. The newly formed assembly of first, second, third and fourth abrasive members 80 is illustrated in FIG. 17.

The steps for constructing the single ply pad are similar to those for the double ply pad, except that the each loop is formed from a single strip S1 and all of the strips S1 are cut to the same length. For a single ply pad 10 having a distance D between opposing ends 26 and 28 of the third and fourth abrasive members 16 and 18 of approximately five inches, the strip width would be 2 inches and the strip length would be 12 inches The strips may be prefolded because the fold locations do not vary from one strip to another. For a single ply pad with overlapping joints, the first portion is approximately twice the length of the second portion and the third portion is approximately the sum of the length of the second portion plus one-half of the width of the strip (to allow for overlap).

The steps for constructing the pad within a pad embodiment are similar to those for the single ply pad except that the strips are cut to different lengths and the strip ends are secured to form butt joints rather than overlapping joints. In addition, construction of the pad in pad is not complete at the same time as construction of the single ply. Instead, a slightly larger outer pad is constructed over the initially formed inner pad. For illustrative purposes, the following Table III may be used when producing an abrading pad 10 having a distance D between opposing ends 26 and 28 of the seventh and eight abrasive members of approximately five inches.

TABLE III

Representative Dimensions for a Five (5) Inch Abrasive Pad

| Abrasive Strip | Strip Width | Strip Length |
|---|---|---|
| 12-S1 (inner pad) | 2 inches | 9.5 inches |
| 14-S1 (inner pad) | 2 inches | 9.5 inches |
| 16-S1 (inner pad) | 2 inches | 9.75 inches |
| 18-S1 (inner pad) | 2 inches | 9.75 inches |
| 12-S1 (outer pad) | 2 inches | 9.875 inches |
| 14-S1 (outer pad) | 2 inches | 9.875 inches |
| 16-S1 (outer pad) | 2 inches | 10 inches |
| 18-S1 (outer pad) | 2 inches | 12 inches |

A strip corresponding to the fifth abrasive member (first abrasive member of the outer pad) may be wrapped around the fourth loop 18-L1 of the inner pad at an angle of approximately 45° from the outermost abrasive member 18 of the inner pad and coaxially aligned with and in substantially overlapping relation to either the first 12 or second 14 abrasive member of the inner pad. The side edges of this strip, which overlap the opposing ends 26, 28 of the fourth loop 18-L1, may be secured to the outer surface of loop 14-L1. These steps may be repeated for strips corresponding to the sixth through eighth abrasive members, varying the position of the strips as described above for the pad in pad.

The final step in making the above described abrasive pads involves forming the aperture 48 by means of punching or other conventional operation, through the assembly 78 proximate the centers 46 of the abrasive members 12, 14, 16 and 18. The pad 10 may be attached to a driven rotating shaft using the aperture 48 or a connector 50 may be passed through the newly formed aperture 48 to provide a reinforced aperture 48 for attaching the pad 10 to a driven rotating shaft. When a connector 50 is used, crimping fingers 54 are then bent into engagement with the fourth abrasive member 18 thereby securing the various abrasive members 12, 14, 16 and 18 into a single abrasive pad 10 as illustrated in FIGS. 1–5

In assembling the abrasive pad, care must be taken to control the area of adhesive application. The adhesive should not be placed too close to the ends 26, 28 of the abrasive members (typically, not closer than about 1¼ inches from the edge on a 5 inch diameter pad), because the adhesive in this region will interfere with the effectiveness of the underlying abrasive material by making it more difficult to expose an underlying layer of fresh abrasive material. The adhesive also may cause streaking on the workpiece. The application of adhesive in the area of the aperture 48 also should be avoided because this may increase the difficulty of forming the aperture 48. Preferably, the adhesive is applied in a circular pattern outside the area where the aperture 48 is to be formed. Instead of using an adhesive such as hot glue to fasten one or more abrasive strips together, it also may be possible to use mechanical fasteners such as staples to hold the abrasive strips in their respective positions. Abrasive pads with mechanical fasteners may not be suitable for applications in which scratching of the workpiece is objectionable but may be suitable for preliminary or rough abrading applications.

Although a specific embodiment of the invention has been described in detail, it is understood that variations may be made thereto by those skilled in the art without departing from the spirit of the invention or the scope of the appended claims.

What is claimed is:

1. An abrasive pad removably attachable to a driven rotatable shaft, said abrasive pad comprising:

a first abrasive member including an outwardly facing surface with a plurality of abrasive particles supported thereon;

a second abrasive member defining a loop including an outwardly facing surface with a plurality of abrasive particles supported thereon; said first abrasive member positioned substantially perpendicular to said second abrasive member, a central portion of said first abrasive member received within the loop of said second abrasive member;

a third abrasive member defining a loop including an outwardly facing surface with a plurality of abrasive particles supported thereon; said third abrasive member positioned angularly intermediate said first and second abrasive members, a central portion of said second abrasive member received within the loop of said third abrasive member; and a fourth abrasive member defining a loop including an outwardly facing surface with a plurality of abrasive particles supported thereon, said fourth abrasive member positioned substantially perpendicular to said third abrasive member and angularly intermediate said first and second abrasive members, a central portion of said third abrasive member received within the loop of said fourth abrasive member.

2. The abrasive pad of claim 1, wherein each of said abrasive members is offset angularly from radially adjacent ones of said abrasive members by approximately 45°.

3. The abrasive pad of claim 1, wherein each of said abrasive members comprises a plurality of abrasive strips aligned in an overlapping relationship.

4. An abrasive pad removably attachable to a driven rotatable shaft, said abrasive pad comprising:

a first abrasive member including opposing ends and a pair of side edges extending between said opposing ends, said first abrasive member further including an outwardly facing surface and a plurality of abrasive particles supported on said outwardly facing surface;

a second abrasive member including a loop having upper and lower portions, opposing ends connecting said upper and lower portions, each of said upper and lower portions having a pair of side edges extending between said opposing ends, said second abrasive member further including an outwardly facing surface and a plurality of abrasive particles supported on said outwardly facing surface, said second abrasive member positioned substantially perpendicular to said first abrasive member and in partial overlapping relationship with said first abrasive member;

a third abrasive member including a loop having upper and lower portions and opposing ends connecting said upper and lower portions, each of said upper and lower portions having a pair of side edges extending between said opposing ends, said third abrasive member further including an outwardly facing surface and a plurality of abrasive particles supported on said outwardly facing surface, said third abrasive member positioned angularly intermediate said first and second abrasive members and positioned in partial overlapping relationship with at least one of said first and second abrasive members; and a fourth abrasive member including a loop having upper and lower portions, opposing ends connecting said upper and lower portions, each of said upper and lower portions having a pair of side edges extending between said opposing ends, said fourth abrasive member further including an outwardly facing surface and a plurality of abrasive particles supported on said outwardly facing surface, said fourth abrasive member positioned substantially perpendicular to said third abrasive member and angularly intermediate said first and second abrasive members, said fourth abrasive member positioned in partial overlapping relationship with at least one of said first and second abrasive members.

5. The abrasive pad of claim 4, wherein said first abrasive member includes a loop having upper and lower portions extending between said opposing ends.

6. The abrasive pad of claim 4, wherein a distance between said opposing ends of said first abrasive member is less than a distance between said opposing ends of said third abrasive member;

said distance between said opposing ends of said first abrasive member is substantially equal to a distance between said opposing ends of said second abrasive member; and said distance between said opposing ends of said third abrasive member is substantially equal to a distance between said opposing ends of said fourth abrasive member.

7. The abrasive pad of claim 6, wherein said opposing ends of said third and fourth abrasive members partially overlap said opposing ends of said first and second abrasive members.

8. The abrasive pad of claim 4, wherein said first abrasive member is partially received between said upper and lower portions of said second, third and fourth abrasive members.

9. The abrasive pad of claim 8, wherein:

said second abrasive member is partially received between said upper and lower portions of said third and fourth abrasive members; and said third abrasive member is partially received between said upper and lower portions of said fourth abrasive member.

10. The abrasive pad of claim 4, wherein each of said abrasive members is offset angularly from radially adjacent ones of said abrasive members by approximately 45°.

11. The abrasive pad of claim 4, wherein each of said abrasive members comprise a plurality of abrasive strips aligned in an overlapping relationship.

12. The abrasive pad of claim 4, further comprising:

a connector supported by said abrasive members and substantially centered intermediate said opposing ends of each of said abrasive members.

13. The abrasive pad of claim 12, wherein said connector comprises an internally threaded rivet extending through each of said abrasive members.

14. An abrasive pad comprising:

a first abrasive strip including a pair of outwardly facing surfaces and a plurality of abrasive particles supported on said pair of outwardly facing surfaces;

a second abrasive strip formed into a loop including a pair of outwardly facing surfaces, a plurality of abrasive particles supported on said pair of outwardly facing surfaces, and a pair of opposing inwardly facing surfaces, said first abrasive strip positioned at an angle to said second abrasive strip and partially received intermediate said opposing inwardly facing surfaces of said loop of said second abrasive strip;

a third abrasive strip formed into a loop including a pair of outwardly facing surfaces, a plurality of abrasive particles supported on said pair of outwardly facing surfaces, and a pair of opposing inwardly facing surfaces, said loops of said first and second abrasive strips positioned at an angle to said third abrasive strip and said loop of said first abrasive strip partially received intermediate said opposing inwardly facing surfaces of said loop of said third abrasive strip; and a fourth abrasive strip formed into a loop including a pair of outwardly facing surfaces, a plurality of abrasive particles supported on said pair of outwardly facing surfaces, and a pair of opposing inwardly facing surfaces, said loop of said third abrasive strip positioned at an angle to said fourth abrasive strip and partially received intermediate said opposing inwardly facing surfaces of said loop of said fourth abrasive strip.

15. The abrasive pad of claim 14, wherein said first abrasive strip is formed into a loop defining said pair of outwardly facing surfaces and a pair of opposing inwardly facing surfaces.

16. The abrasive pad of claim 15, wherein each of said loops include upper and lower portions and opposing edges connecting said upper and lower portions, said edges of all of said loops disposed substantially in a single plane.

17. The abrasive pad of claim 16, wherein said opposing ends of said loops of said third and fourth abrasive strips partially overlap said opposing ends of at least one of said loops of said first and second abrasive strips.

18. The abrasive pad of claim 14, wherein each of said abrasive strips comprises a plurality of abrasive strips aligned in an overlapping relationship.

19. The abrasive pad of claim 14, wherein each of said loops is offset angularly from radially adjacent ones of said loops by approximately 45°.

20. The abrasive pad of claim 14, further comprising:

a connector supported by said abrasive strips.

21. The abrasive pad of claim 20, wherein said connector comprises an internally threaded rivet.

22. A method of making an abrasive pad, said method comprising the steps of:

providing first, second, third and fourth abrasive members each including an outwardly facing surface with a plurality of abrasive particles supported thereon;

folding each of said second, third, and fourth abrasive members to define a loop;

positioning said first abrasive member substantially perpendicular to said second abrasive member;

causing a central portion of said first abrasive member to be received within the loop of said second abrasive member;

positioning said third abrasive member angularly intermediate said first and second abrasive members;

causing a portion of said second abrasive member to be received within the loop of said third abrasive member;

positioning said fourth abrasive member substantially perpendicular to said third abrasive member and angularly intermediate said first and second abrasive members; and causing a central portion of said third abrasive member to be received within the loop of said fourth abrasive member.

23. A method of making an abrasive pad, said method comprising the steps of:

providing first, second, third and fourth strips of abrasive material, each of said strips having first and second surfaces and an abrasive disposed on said second surface;

folding said first strip into a first loop wherein said second surface defines a pair of outwardly facing abrasive surfaces, said first surface defines a pair of opposed inwardly facing surfaces, and a pair of end edges connect said pairs of outwardly and inwardly facing surfaces;

positioning said second strip in angularly offset relation to said first loop and intermediate said pair of end edges of said first loop, wherein a portion of said first surface of said second strip engages a portion of one of said outwardly facing surfaces of said first loop;

folding said second strip into a second loop wherein said second surface defines a pair of outwardly facing abrasive surfaces, said first surface defines a pair of opposed inwardly facing surfaces, a pair of end edges connect said pairs of outwardly and inwardly facing surfaces, and said first loop is partially received intermediate said opposed inwardly facing surfaces of said second loop;

positioning said third strip in angularly offset relation to said first and second loops wherein a portion of said first surface of said third strip engages a portion of one of said outwardly facing surfaces of at least one of said first and second loops;

folding said third strip into a third loop wherein said second surface of said third strip defines a pair of outwardly facing abrasive surfaces, said first surface defines a pair of opposed inwardly facing surfaces, a pair of end edges connect said pairs of outwardly and inwardly facing surfaces, and said first and second loops are partially received intermediate said opposed inwardly facing surfaces of said third loop;

positioning said fourth strip in angularly offset relation to said first and second loops wherein a portion of said first surface of said fourth strip engages a portion of one of said outwardly facing surfaces of said third loop; and folding said fourth strip into a fourth loop wherein said second surface of said fourth strip defines a pair of outwardly facing abrasive surfaces, said first surface defines a pair of opposed inwardly facing surfaces, a pair of end edges connect said pairs of outwardly and inwardly facing surfaces, and said third loop is partially received intermediate said opposed inwardly facing surfaces of said fourth loop.

24. The method of claim 23, further comprising the steps of:

forming an aperture through said loops intermediate said end edges of loops;

inserting a connector through said aperture; and securing said connector to said loops.

25. The method of claim 23, further comprising the steps of:

securing said second loop to said first loop after said step of folding said second strip;

securing said third loop to said second loop after said step of folding said third strip; and securing said fourth loop to said third loop after said step of folding said fourth loop.

26. The method of claim 23, wherein said steps of folding said third and fourth strips include partially covering said end edges of said first and second loops with said end edges of said third and fourth loops.

27. A method of making an abrasive pad, said method comprising the steps of:

providing first, second, third, and fourth abrasive members each including an outwardly facing surface with a plurality of abrasive particles supported thereon;

folding each of said second, third, and fourth abrasive members to define a loop;

positioning said first abrasive member substantially perpendicular to said second abrasive member;

causing a central portion of said first abrasive member to be received within the loop of said second abrasive member;

securing said first abrasive member to said second abrasive member;

positioning said third abrasive member angularly intermediate said first and second abrasive members;

causing a central portion of said second abrasive member to be received within the loop of said third abrasive member;

securing said third abrasive member to said second abrasive member;

positioning said fourth abrasive member substantially perpendicular to said third abrasive member and angularly intermediate said first and second abrasive members;

causing a central portion of said third abrasive member to be received within the loop of said fourth abrasive member, and securing said fourth abrasive member to said third abrasive member.

* * * * *